US009114617B2

(12) United States Patent
Sato et al.

(10) Patent No.: US 9,114,617 B2
(45) Date of Patent: Aug. 25, 2015

(54) LIQUID DISCHARGE HEAD MANUFACTURING METHOD

(75) Inventors: Tamaki Sato, Kawasaki (JP); Masafumi Morisue, Tokyo (JP); Hirono Yoneyama, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 374 days.

(21) Appl. No.: 13/634,514

(22) PCT Filed: Mar. 28, 2011

(86) PCT No.: PCT/JP2011/001811

§ 371 (c)(1),
(2), (4) Date: Sep. 12, 2012

(87) PCT Pub. No.: WO2011/121972

PCT Pub. Date: Oct. 6, 2011

(65) Prior Publication Data

US 2013/0004668 A1 Jan. 3, 2013

(30) Foreign Application Priority Data

Mar. 31, 2010 (JP) ..... 2010-082799
Nov. 29, 2010 (JP) ..... 2010-265096

(51) Int. Cl.
*B41J 2/05* (2006.01)
*B41J 2/16* (2006.01)
*B41J 2/14* (2006.01)

(52) U.S. Cl.
CPC ..... *B41J 2/1603* (2013.01); *B41J 2/164* (2013.01); *B41J 2/1626* (2013.01); *B41J 2/1631* (2013.01); *B41J 2/1645* (2013.01); *B41J 2002/14475* (2013.01)

(58) Field of Classification Search
CPC ..... B41J 2/163; B41J 2/1404; B41J 2/1628
USPC ..... 347/20, 44, 65; 427/259
See application file for complete search history.

(56) References Cited

U.S. PATENT DOCUMENTS

| | | | | |
|---|---|---|---|---|
| 5,482,660 | A * | 1/1996 | Yamamoto et al. | 264/474 |
| 6,145,965 | A * | 11/2000 | Inada et al. | 347/65 |
| 6,331,259 | B1 * | 12/2001 | Ozaki et al. | 216/27 |
| 8,227,043 | B2 * | 7/2012 | Kubota et al. | 427/407.1 |
| 8,586,351 | B2 * | 11/2013 | Villa et al. | 435/287.2 |
| 2006/0109315 | A1 * | 5/2006 | Sato et al. | 347/61 |
| 2006/0125884 | A1 | 6/2006 | Sato et al. | |

FOREIGN PATENT DOCUMENTS

| | | | |
|---|---|---|---|
| CN | 1968815 | A | 5/2007 |
| CN | 101161459 | A | 4/2008 |

(Continued)

*Primary Examiner* — Cachet Sellman
(74) *Attorney, Agent, or Firm* — Canon USA, Inc., IP Division

(57) ABSTRACT

A method of manufacturing a liquid discharge head having a flow path communicating with a discharge port for discharging liquid includes in the following order: preparing a substrate with an evenly provided first layer as a flat layer; forming, of the first layer, a pattern of the flow path for forming the flow path, and a member (A) provided outside the pattern via a gap; providing a second layer so as to fill the gap and to cover the pattern and the member (A); forming, of the second layer, a member (B) for forming the discharge port on the pattern; and removing the member (A), providing, at least on the substrate, a third layer so as to hold it in intimate contact with the member (B), and removing the pattern to form the flow path.

10 Claims, 10 Drawing Sheets

(56) References Cited

FOREIGN PATENT DOCUMENTS

| | | | |
|---|---|---|---|
| CN | 101316713 | A | 12/2008 |
| EP | 1380424 | A | 1/2004 |
| JP | 2004262225 | A | 9/2004 |

* cited by examiner

LIQUID DISCHARGE HEAD MANUFACTURING METHOD

TECHNICAL FIELD

The present invention relates to a method of manufacturing a liquid discharge head for discharging liquid.

BACKGROUND ART

A typical example of a liquid discharge head is an ink jet recording head applicable to an ink jet recording system in which recording is effected by discharging ink onto a recording medium. In general, the ink jet recording head is equipped with an ink flow path, a discharge energy generation portion provided in a part of the flow path, and a minute discharge port for discharging ink by the energy generated in the energy generation portion.

U.S. Pat. No. 6,145,965 discusses a method for manufacturing a liquid discharge head applicable to an ink jet recording head. In this method, a flow path pattern is formed on a substrate with a plurality of discharge energy generation portions, by a photosensitive material, and a peripheral portion pattern material is formed around the flow path pattern. A coating resin layer is provided thereon constituting a flow path wall member which forms the flow path wall. Coating property at the corner portions of the flow path pattern is improved by providing peripheral portion pattern material. And, at positions opposed to the each discharge energy generation portions, openings constituting a plurality of discharge ports are formed, and then the pattern is removed, thereby forming a space constituting the flow path. In recent years, higher level of image quality and an increase in recording speed are required of recording apparatuses, so that there is a demand for a plurality of discharge ports and flow paths communicating therewith at high density, and for more uniformity of the volume of the discharged droplets. Thus, to make the distance between the plurality of discharge energy generation portions and the corresponding discharge ports more uniform, there is a demand for flattening of the discharge port surface in which the openings of the discharge ports are formed.

In the case where the distance between the discharge energy generation portions and the discharge ports is made uniform by utilizing the method of U.S. Pat. No. 6,145,965, it might be possible to make the upper surface of the coating resin layer flatter by reducing the distance between the flow path pattern and the peripheral portion pattern material. In that case, however, as a result of reducing the distance between the peripheral portion pattern material and the flow path pattern, the wall of the flow path formed at that portion may become thin, so that the mechanical strength of the flow path wall may become weak. Further, the contact area between the flow path wall and the substrate may become small, so that bonding strength becomes weak. In such cases, the reliability of the liquid discharge head may be deteriorated.

In the case where the liquid discharge ports and the liquid flow paths are arranged at high density, the walls dividing the flow paths from each other must be relatively thin in the first place, so that further care must be taken to prevent a reduction in the general strength of the flow path walls.

CITATION LIST

Patent Literature

PTL 1: U.S. Pat. No. 6,145,965

SUMMARY OF INVENTION

The present invention is directed to a manufacturing method which helps attain compatibility between an improvement in the flatness of the discharge port surface and maintenance of the requisite mechanical strength of the flow path walls and which enables manufacturing of a highly reliable liquid discharge head capable of discharging droplets of uniform volume repeatedly, at high yield ratio in a stable manner.

According to the present invention, it is possible to manufacture with high yield a highly reliable liquid discharge head in which variation in the volume of the discharged droplets is further reduced, which can discharge droplets of uniform volume repeatedly in a stable manner, and which is equipped with flow path walls of sufficient mechanical strength.

According to an aspect of the present invention, a method of manufacturing a liquid discharge head having a flow path communicating with a discharge port for discharging liquid includes in the following order: preparing a substrate with an evenly provided first layer as a flat layer; forming, of the first layer, a pattern of the flow path for forming the flow path, and a member (A) provided outside the pattern via a gap; providing a second layer so as to fill the gap and to cover the pattern and the member (A); forming, of the second layer, a member (B) for forming the discharge port on the pattern; and removing the member (A), providing, at least on the substrate, a third layer so as to hold it in intimate contact with the member (B), and removing the pattern to form the flow path.

Further features and aspects of the present invention will become apparent from the following detailed description of exemplary embodiments with reference to the attached drawings.

BRIEF DESCRIPTION OF DRAWINGS

The accompanying drawings, which are incorporated in and constitute a part of the specification, illustrate exemplary embodiments, features, and aspects of the invention and, together with the description, serve to explain the principles of the invention.

FIG. 1 is a schematic perspective view of an exemplary example of a liquid discharge head obtained by a liquid discharge head manufacturing method according to the present invention.

[FIG. 2]

[FIG. 3]

FIG. 4 is a schematic sectional view illustrating how a process is performed in a liquid discharge head manufacturing method according to the exemplary example of the present invention.

[FIG. 5]

[FIG. 6]

[FIG. 7]

[FIG.8 ]

[FIG. 9]

[FIG. 10]

DESCRIPTION OF EMBODIMENTS

Various exemplary embodiments, features, and aspects of the invention will be described in detail below with reference to the drawings.

A liquid discharge head obtained by the present invention can be mounted on, for example, a printer, a copying machine, a facsimile apparatus, and a word processor with a printer unit, and, further, on an industrial recording apparatus combined with various processing apparatuses. For example, it can be adopted in apparatuses for preparing biochips, printing electronic circuits, discharging chemicals in a mist form, etc.

Figure 1:
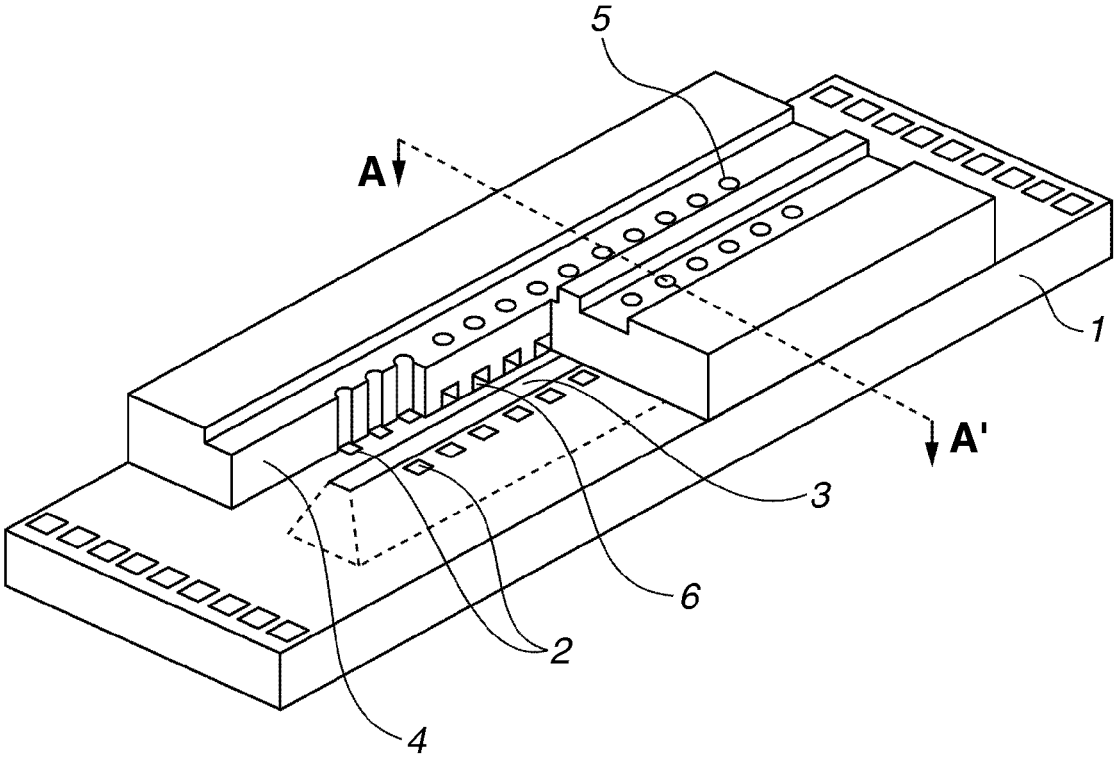
[FIG. 1]

FIG. 1 is a schematic perspective view of an example of a liquid discharge head according to the present invention.

The liquid discharge head of the present invention illustrated in FIG. 1 has a substrate 1 in which there are formed at a predetermined pitch energy generation elements 2, which generates energy used to discharge a liquid such as ink. In the substrate 1, a supply port 3 for supplying liquid is provided between two rows of energy generation elements 2. On the substrate 1, there are formed discharge ports 5 opening over the energy generation elements 2, and individual liquid flow paths 6 communicating with the discharge ports 5 from the supply port 3.

A flow path wall member 4 forming the wall of the individual flow paths 6 communicating with the discharge ports 5 from the supply port 3 is formed integrally with the discharge port member in which the discharge ports 5 are provided.

Next, a typical example of a liquid discharge head manufacturing method according to the present invention will be illustrated with reference to FIGS. 2A through 2J. FIGS. 2A through 2J are schematic sectional views of a liquid discharge head manufactured by a first exemplary embodiment of the present invention taken along a plane comprising the line A-A' of FIG. 1 and perpendicular to the substrate 1, illustrating the section in each process.

Figure 2A:
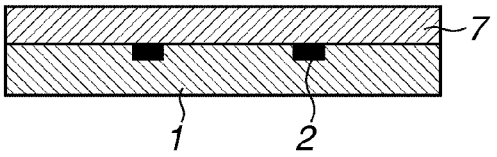
FIGS. 2A through 2J are schematic sectional views illustrating a liquid discharge head manufacturing method according to the exemplary example of the present invention.

As illustrated in FIG. 2A, a first layer 7 is provided evenly on the substrate 1 which has, on its surface, an energy generation elements 2 generating energy to be used to discharge liquid. First, the substrate 1 in this state is prepared (process A). Although in the following description a single liquid discharge head unit is illustrated, it is also possible to provide a plurality of liquid discharge head units on a single wafer using 6 to 12 inches wafer as the substrate 1 to finally divide the wafer through a cutting process to obtain a single liquid discharge head.

The first layer 7 is formed of resin material such as positive type photosensitive resin material, and is provided on the substrate 1 through application or in the form of a film laminated thereon. The layer is removed from the substrate 1 later, so that the layer may be dissoluble to allow easily removal. In particular, it is useful to adopt poly-methylisopropenylketone or a copolymer of methacrylic acid and methacrylate. The reason for this is that the above compound can be easily removed by solvent; further, due to its simple composition, its components little affect a second layer 10.

Figure 2B:
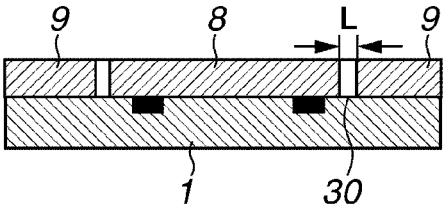

Next, as illustrated in FIG. 2B, there are formed, from the first layer 7, a liquid flow path pattern 8, and a member (A) 9 on the outer side thereof with a gap therebetween, with their upper surfaces being flush with each other (process B). By removing a portion of the first layer 7, the pattern 8 is formed on the energy generation elements 2, and the member (A) 9 is formed on the outer side thereof, with their upper surfaces being flush with each other. In the case where a positive type photosensitive resin is used for the first layer 7, it is possible to perform exposure and development on the first layer 7 and to remove a portion thereof. It is also possible to perform dry etching on the first layer 7.

Figure 5A:
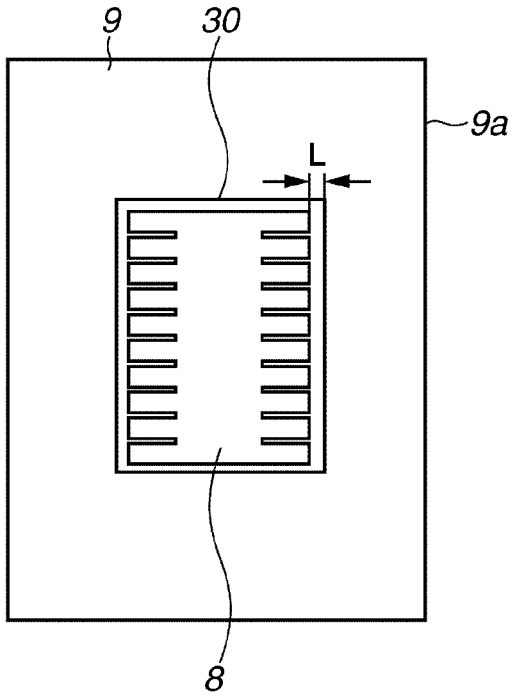
FIGS. 5A and 5B are schematic views illustrating how a process is performed in a liquid discharge head manufacturing method according to the exemplary example of the present invention.
Figure 5B:
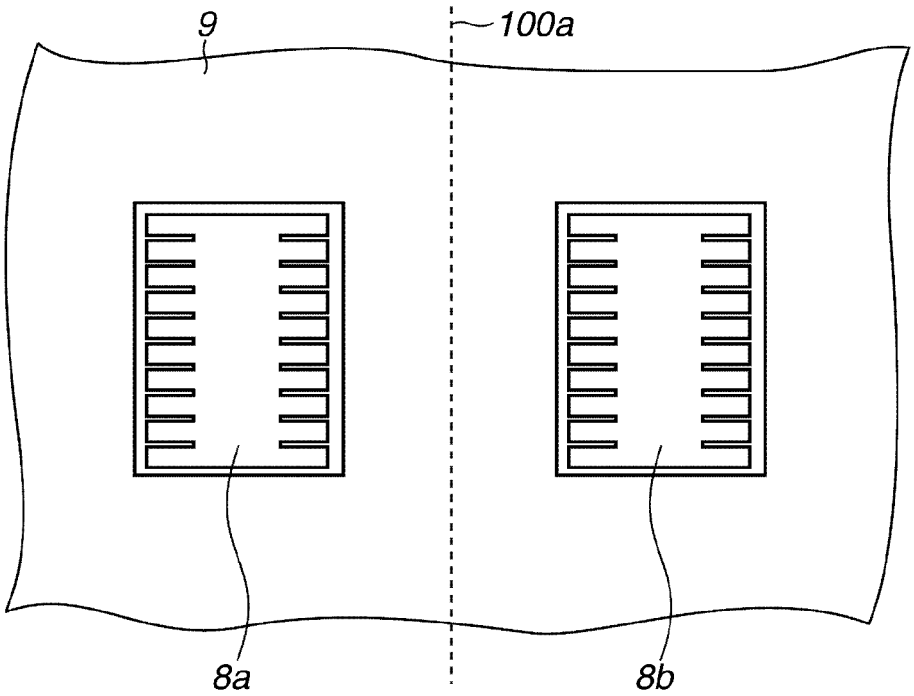

FIGS. 5A and 5B are schematic views, as seen from above, of the pattern 8 and the member (A) 9 provided on the substrate in the state as illustrated in FIG. 2B. As illustrated in FIG. 5A, the member (A) 9 is provided on the outer side of the pattern 8 to surround the pattern 8. In FIG. 5A, the contour 9a of the member (A) 9 corresponds to a unit region of one liquid discharge head. The length L of the gap 30 between the pattern 8 and the member (A) 9 in a direction substantially parallel to the substrate surface may be preferably 40 micrometers or less so that a second layer 10 may be flatly applied later to the pattern 8 and the member (A) 9. From the same point of view, in a direction substantially parallel to the plane of the substrate 1, the area of the member (A) 9 may be preferably large as compared with that of the pattern 8; the area of the member (A) 9 may be preferably not less than three times as large as the area of the pattern. As illustrated in FIG. 5B, in the case where a plurality of liquid discharge head units is collectively provided, the member (A) 9 is provided between a pattern 8*a* and a pattern 8*b* each corresponding to one liquid discharge head unit. At this time, the member (A) 9 is provided astride the border 100*a* (dotted line) between the units of one liquid discharge head. The border 100*a* may be a line formed by actually providing protrusions and recesses on the substrate or may be an imaginary line; by cutting the substrate along the border 100*a*, it is possible to extract one liquid discharge head unit.

Figure 2C:
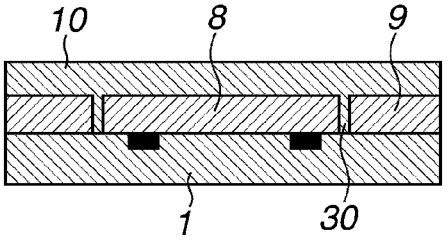

Next, as illustrated in FIG. 2C, the second layer 10 is provided to cover the pattern 8 and the member (A) 9 (process C). Examples of the method of providing the second layer 10 include spin coating, curtain coating, and lamination. Preferably, the second layer 10 is formed of a negative type photosensitive resin composition including a resin having a polymerization group, such as epoxy group, oxetane group, or vinyl group, and a polymerization initiator corresponding to the resin. This is because a resin including a functional group as mentioned above exhibits high polymerization reactivity, so that a member (B) for forming a discharge port of high mechanical strength can be obtained.

The thickness of the first layer 7 and the thickness of the second layer 10 can be set as appropriate. When forming a discharge port for discharging a minute droplet on the order of several picoliters, and a liquid flow path corresponding thereto, the first layer 7 may be preferably formed in a thickness of not less than 3 micrometers and equal to or smaller than 15 micrometers, and the second layer 10 may be preferably formed in a thickness of not less than 3 micrometers and equal to or smaller than 10 micrometers from the upper surface of the pattern 8.

The gap 30 is formed to be very small, so that the second layer 10 is provided flat on the upper surfaces of the pattern 8 and the member (A) 9. At this time, the second layer 10 enters the gap 30, and the portion constitutes a part of the flow path wall member 4.

Next, a member (B) for forming discharge ports in the second layer 10 is formed (process D). The member (B) for forming discharge ports is provided with through-holes constituting the discharge ports; the through-holes may be preferably provided finely and with high positional precision by photolithography as described below.

Figure 2D:
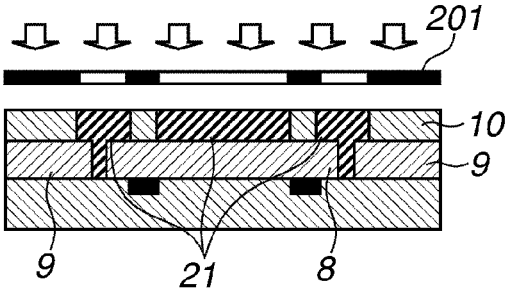
Figure 2E:
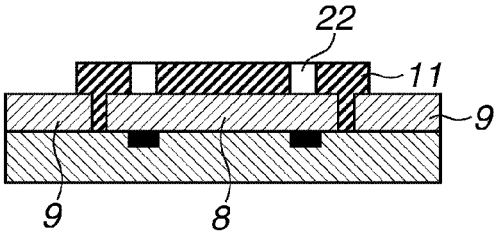

First, as illustrated in FIG. 2D, pattern exposure is performed on the second layer 10. The exposure is performed on the second layer 10 via a mask 201, curing exposed portions 21. Heating may be performed as needed, thereby promoting the curing. Next, as illustrated in FIG. 2E, development is effected on the second layer 10 to remove the unexposed portion of the layer 10, forming a discharge port formation member (B) 11. At this time, holes 22 partially constituting the discharge ports are simultaneously formed. The holes 22 may be formed at positions opposed to the energy generation surfaces of the energy generation elements 2; however, the position is not limited to this. In this way, by appropriately setting the distance between the pattern 8 and the member (A) 9, the second layer 10 is formed evenly on the member (A) 9; when the second layer 10 is in a flat state, it is possible to obtain, from the second layer 10, a member (B) 11 substantially free from variation in thickness. It is also possible to form the holes 22 by dry etching or the like using a mask for discharge port formation after the forming of the member (B) 11 through removal of the unexposed portion of the layer 10. Also after the execution of process D, the flatness of the member (B) 11 is maintained, so that the length (in the thickness direction of the member (B)) of the obtained holes 22 is uniform within the substrate.

When a liquid repellent material is imparted to the surface of the second layer 10, the upper surface of the member (B) 11 (i.e., the surface of the member (B) on the side opposite to the substrate 1 side) functions as a liquid-repellent surface, and no liquid such as ink adheres to the upper surface of the member (B) 11, which is advantageous. When the liquid to be discharged is an ink containing pigment and dye, an imparted liquid repellency which makes forward contact angle of water 80 degrees or more would be sufficient. A forward contact angle of 90 degrees or more may be useful since it further helps suppress adhesion of liquid to the member (B) 11.

Figure 2F:
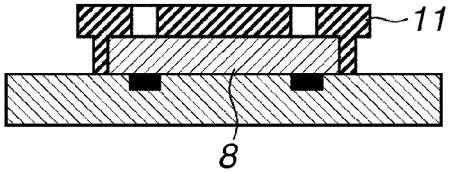

Next, as illustrated in FIG. 2F, the member (A) 9 is removed (process E). The removal of the member (A) 9 is effected, for example, by dissolving the member (A) 9 in liquid. The member (B) is cured, and its configuration undergoes substantially no change, so that the pattern 8 may be removed along with the member (A) 9; however, if a third layer described below is to be prevented from entering the space constituting the flow path, the pattern 8 may be left. In the case where the member (A) 9 is formed of resin, the member (A) 9 is selectively exposed to light such as ultraviolet rays so that the dissolution selection ratio with respect to liquid as compared with the pattern 8, which is not exposed to the light, is increased. Then the member (A) 9 is dissolved in liquid, to selectively remove the member (A) 9.

Figure 2G:
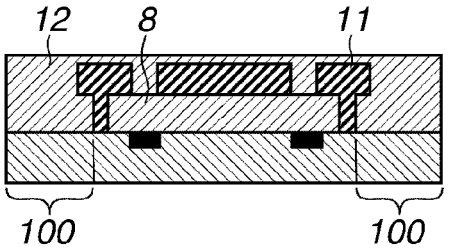

Next, as illustrated in FIG. 2G, a third layer 12 is provided on the substrate 1, from which the member (A) 9 has been removed, to be located close to the member (B) 11 (process F). The member (B) is reinforced by the third layer located close to the member (B). In particular, a portion corresponding to the gap 30 of the member (A) 9 is very thin, so that by reinforcement with the third layer, its strength is greatly increased. The third layer 12 may be formed of a negative type photosensitive resin of the same composition as the second layer 10; more specifically, the compound contained in the third layer and that contained in the second layer 10 may be identical with each other. This helps to efficiently effect the bonding with the member (B) 11 obtained from the second layer 10 when the third layer 12 is cured. However, there is no need for their composition ratio to be identical. Regarding the thickness of the third layer 12, the upper surface position thereof may be higher (thicker) than the upper surface position of the member (B) 11, equal thereto, or lower (thinner) than that. From the viewpoint of the strength of the flow path wall, it is desirable for the contact area between the third layer and the member (B) to be large, so that it is desirable for the third layer to be thicker than the pattern 8, and, more preferably, thicker than the member (B). Through the provision of the layer 12, the bonding portion between the flow path wall member 4 and the substrate 1 is increased, so that the strength of the flow path wall member 4 is increased. Further, on the portion 100 of the substrate 1 where the third layer 12 is provided, there are provided transistors or the like used in a drive circuit for driving the energy generation elements 2, so that the protectiveness with respect to the drive circuit is also improved. Further, a portion of the third layer 12 enters the holes 22, and this portion is finally removed. When a portion of the third layer 12 has entered the holes 22, it is possible to reduce the swelling of this portion of the pattern 8 when curing the layer 12. It is not absolutely necessary for a portion of the third layer to enter the holes 22; depending on the configuration and size of the holes 22, the third layer 12 may not enter the holes 22.

Figure 2H:
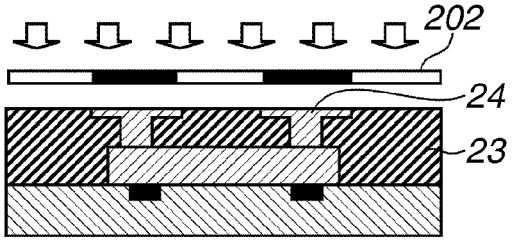

Next, as illustrated in FIG. 2H, exposure is performed on the third layer 12 via a mask 202, curing the exposed portion 23. The portion 24 that has not undergone exposure is not cured. Of the third layer 12, it is necessary to remove the portion thereof corresponding to the interior of the holes 22 constituting the discharge ports and the portion above the same, so that shielding is effected thereon by the mask 202.

Figure 2I:
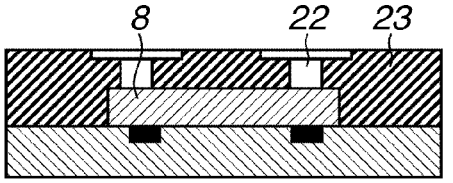

Next, as illustrated in FIG. 2I, the portion 24 that has not undergone exposure is removed, for example, by a liquid development method. When the removal is to be effected by dissolution, there is employed an appropriate solvent such as xylene corresponding to the composition of the negative type photosensitive resin. As a result, the pattern 8 is exposed to the exterior through the holes 22.

Figure 2J:
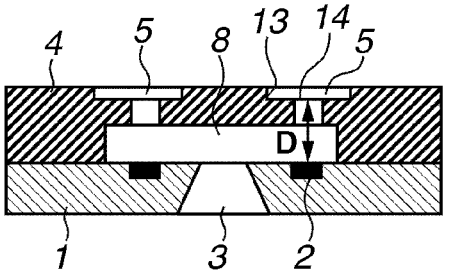

Next, as illustrated in FIG. 2J, dry etching, wet etching or the like is performed on the substrate 1 to form the supply port 3, and the pattern 8 communicates with the exterior, forming the liquid flow paths 6 communicating with the discharge ports 5 through dissolution of the pattern 8 in an appropriate solvent (process G). The flow path wall member 4 has a wall surface 13 adjacent to the surface in which the discharge ports 5 are open. The distance between the wall surface 13 and the discharge ports 5 is set such that the liquid to be discharged can form meniscus within the discharge ports 5, that is, on the substrate 1 side of the opening surface 14. For example, when the diameter of the discharge ports is 15 micrometers, the distance between the wall surface 13 and the edges of the discharge ports 5 is preferably 80 micrometers or more. After the formation of the member (B) 11, the flatness of the member (B) is not impaired in the subsequent processes, so that, within the substrate, the distance D between the energy generation surface of the substrate 1 and the discharge ports 5 is uniform. Thus, the amount of liquid discharged from the plurality of discharge ports becomes constant. After this, a liquid repelling function may be imparted to the opening surface 14 of the discharge ports 5.

Here, referring to FIGS. 7A through 7C and FIGS. 8A and 8B, a processing for flattening the upper surface of the first layer 7, which can be performed in the present exemplary embodiment, will be described.

FIGS. 7A through 7C and FIGS. 8A and 8B are sectional views each illustrating the cross section in each process. The cross sections of FIGS. 7A through 7C and FIGS. 8A and 8B are similar to those of FIGS. 2A through 2J.

The upper surface flattening processing for the first layer 7 can be conducted in parallel with one of the processes prior to process C or between any of the processes.

Figure 7A:
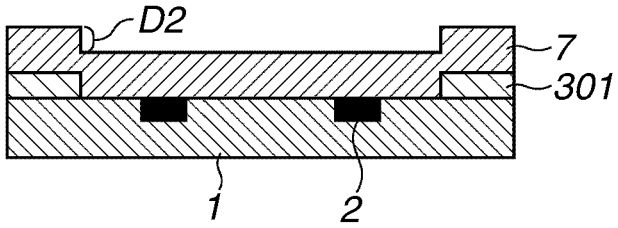
FIGS. 7A through 7C are schematic sectional views illustrating how each process is performed in a liquid discharge head manufacturing method according to the exemplary example of the present invention.

As illustrated in FIG. 7A, on the substrate 1 whose surface is equipped with the energy generation elements 2 generating energy utilized for discharging liquid, there are provided a patterned adhesion improving member (c) 301 and the first layer 7 in that order. The member (c) 301 is a member used for making the contact firmer between the substrate and the flow path wall, and protecting the wiring portion on the substrate, etc. It can be provided corresponding to the configuration of the flow path wall. The member (c) 301 is imparted onto the substrate 1 by spin coating, lamination or the like using a resin material such as polyether amide, and is formed by dry etching. In the case where a photosensitive resin is used, it can be formed in a thickness of approximately 1 to 3 micrometers by performing exposure/development instead of dry etching. After the formation of the member (c) 301 in the region including the bonding position between the flow path wall member 4 and the substrate 1, the first layer 7 is stacked to cover the member (c) 301. Here, a step D2 is generated on the surface of the first layer 7 between the portion where the member (c) 301 exists and the portion where none exists.

The size of the step D2 differs depending on the relationship between the thickness of the adhesion improving member and the thickness of the first layer 7; depending upon the size of the step D2, it is possible to perform processing for reducing the same. After the provision of the patterned member (c) 301 and the first layer 7 in that order, prior to performing process C, the thickness of the first layer 7 is reduced. Specifically, the first layer 7 may be partially reduced in thickness so that the step D2 becomes as small as possible.

Figure 7B:
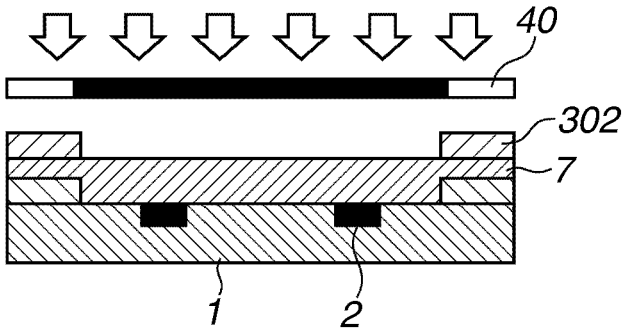
Figure 7C:
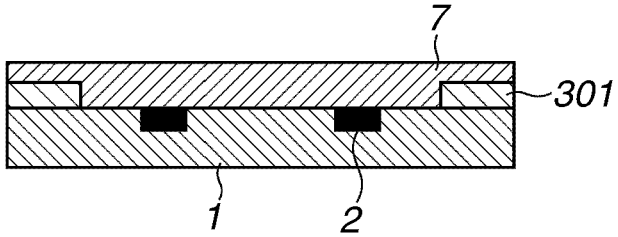

As illustrated in FIG. 7B, in the case where the first layer 7 is formed of a positive type photosensitive resin, exposure is performed on the portion of the first layer 7 over the adhesion improving member with an exposure amount smaller than the requisite minimum exposure amount for entirely removing the first layer 7 in the depth direction. And, only a portion of the upper surface is formed into an exposure portion 302 dissoluble in developer fluid. Next, as illustrated in FIG. 7C, the exposure portion 302 is removed by developer fluid. Next, there is executed process B for forming the pattern 8 and the member (A) 9 with the gap 30 therebetween, and, after the process illustrated in FIG. 2C (process C), the method is conducted as in the first exemplary embodiment, manufacturing a liquid discharge head.

While in this example the processing for flattening the upper surface of the first layer 7 is executed before process B, this may be performed in one of the processes prior to process C or between some such processes. For example, in the case where the sensitivity of the positive type photosensitive resin used for the first layer 7 is high and where it is difficult to adjust the layer thickness, which is reduced depending on the exposure amount, it is also possible to control the degree to which the first layer 7 is thinned by adding an ionizing radiation absorption material of a photosensitive wavelength region.

Figure 8A:
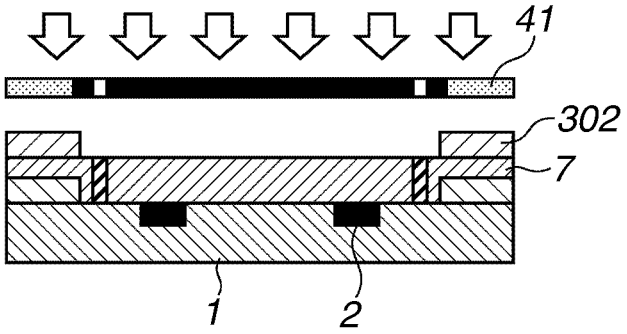
FIGS. 8A and 8B are schematic sectional views illustrating how each process is performed in a liquid discharge head manufacturing method according to the exemplary example of the present invention.
Figure 8B:
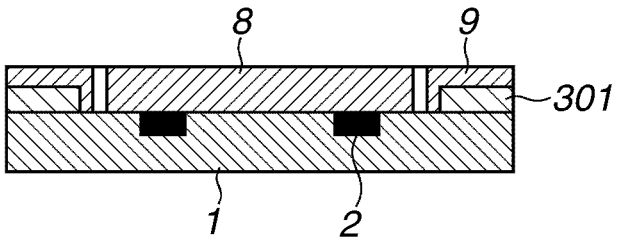

Further, as illustrated in FIG. 8A, in the exposure process illustrated in FIG. 7B, it is also possible to collectively perform an exposure using a halftone mask 41 to develop solely the upper surface side of the first layer 7, and an exposure to effect removal into a deep part through development. Through adjustment of the ionizing radiation transmittance by the halftone portion of the mask, only a part of the upper surface of the first layer 7 is formed into the exposure portion 302 dissoluble in developer fluid. And, by performing development, there are formed, as illustrated in FIG. 8B, the pattern 8 and the member (A) 9 such that their respective upper surfaces are aligned with each other. While in the illustrated example the halftone portion of the mask corresponds to the position where the member (A) 9 is formed, it is also possible to perform exposure using the halftone portion of the mask as the portion corresponding to the pattern 8 of the first layer 7. Further, it is not only possible to remove only the upper surface of one of them through development, but also to remove the upper surface portions of both of them through development in different removal ratios.

Figure 3A:
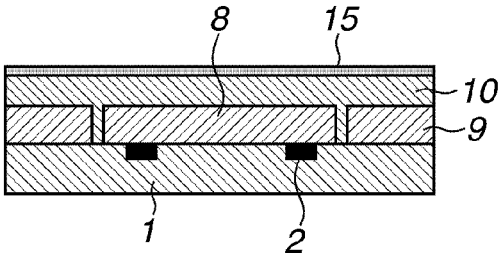
FIGS. 3A through 3E are schematic sectional views illustrating how each process is performed in a liquid discharge head manufacturing method according to the exemplary example of the present invention.
Figure 3D:
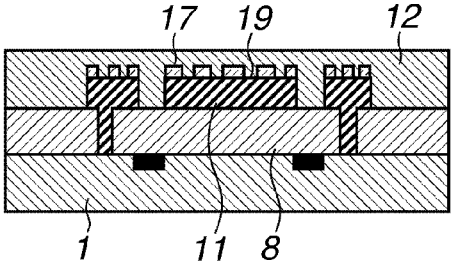
Figure 3B:
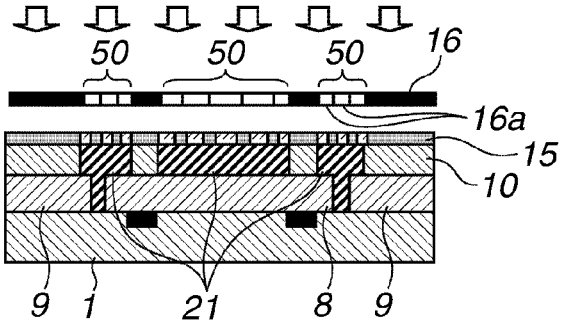
Figure 3E:
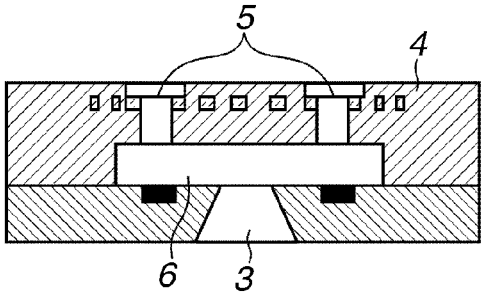
Figure 3C:
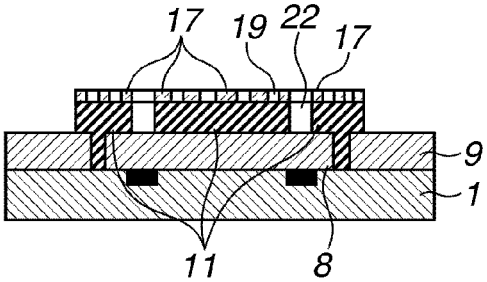
Figure 4:
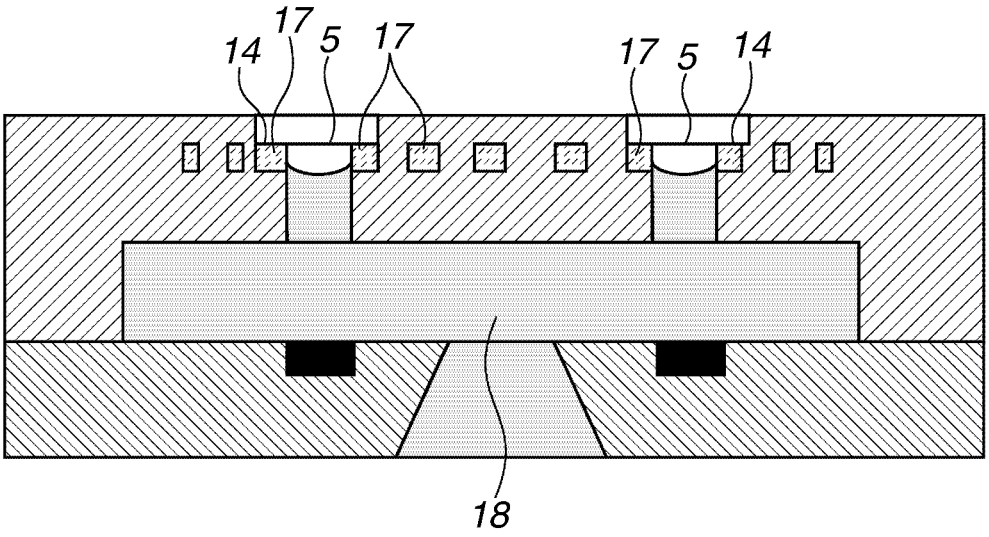
[FIG. 4]

Referring to FIGS. 3A through 3E and FIG. 4, a second exemplary embodiment of the present invention will be described. FIGS. 3A through 3E are sectional views illustrating the section in each process. FIG. 4 is a sectional view for illustrating the liquid discharge head obtained by the present exemplary embodiment. The sections of FIGS. 3A through 3E and FIG. 4 are similar to those of FIGS. 2A through 2J.

In the present exemplary embodiment, the processes up to the process illustrated in FIG. 3A (process A) are conducted in the same manner as in the first exemplary embodiment. Next, in the process (process B) for forming the member(B) 11, the following is performed. As illustrated in FIG. 3A, there is provided a liquid repellent material 15 for imparting repellency to the upper surface of the second layer 10. It is also possible to cause a part or all of the liquid repellent material 15 to permeate the second layer 10. In the case where the liquid to be discharged is a water ink or oil-based ink, a thickness of 2 micrometers is enough for the thickness of the portion to which liquid repellency is imparted, in a direction perpendicular to the substrate. The liquid repellent material 15 is stacked on the substrate evenly similarly to the first layer 7 and the second layer 10. It is possible to adopt, as the liquid repellent material 15, a photosensitive fluorine containing epoxy resin, a composition containing a condensate of fluorine containing silane and polymerization group containing silane, etc. In the case where a material as mentioned above is used for the liquid repellent material 15, it is possible to perform patterning collectively on the liquid repellent material 15 and the second layer 10 through photolithography.

Next, as illustrated in FIG. 3B, the second layer 10 and the liquid repellent material 15 are exposed via a mask 16 for forming a member (B) 11. The configuration of the mask is adjusted to expose a portion of the liquid repellent material 15, and not to expose a rest thereof. More specifically, the second layer 10 and the liquid repellent material 15 are exposed by the mask 16 provided with a shielding slit portion 16*a* within an opening 50. The width of the shielding slit portion 16*a* is adjusted not to expose the liquid repellent material 15 and expose the second layer 10. Next, after curing the exposed portion, development is performed to remove the unexposed portions of the second layer 10 and the liquid repellent material 15. By the above operation, as illustrated in FIG. 3C, it is possible to provide a liquid repellent portion 17 around the holes 22 constituting the discharge ports of the member (B) 11. Of the liquid repellent material, the unexposed portion corresponding to the shielding slit portion 16*a* is removed, so that repellency is not imparted to that portion and becomes a non-liquid-repellent portion 19.

Next, after removing the unexposed portions of the second layer 10, a third layer 12 is provided on the upper surface of the member (B) 11. In the liquid-repellent portion 17 of the member (B), it is possible that the third layer 12 is repelled, whereas, in the non-liquid-repellent portion 19 of the upper surface of the member (B), the third layer 12 is held in intimate contact with the upper surface of the member (B) 11. Further, liquid repellency is not imparted to the outer side surface of the member (B), either, so that this is also held in intimate contact with the third layer 12.

After this, a necessary portion of the third layer 12 is cured, the supply port 3 is formed in the substrate 1 and the pattern 8 is removed to form the flow path 6, whereby the liquid discharge head is obtained as illustrated in FIG. 3E. As illustrated in FIG. 4, in the liquid discharge head manufactured by the second exemplary embodiment, repellency is imparted to the opening surface 14 where the discharge ports 5 of the member (B) 11 are open. Thus, the liquid 18 to be discharged filling the flow path does not stay on the opening surface 14, and can form meniscus at positions substantially same as the discharge ports 5. Even in a case where a portion of the liquid discharged floats in a mist-like fashion to adhere to the opening surface 14, the mist is restrained from attaching to the opening surface 14, and the mist is easily removed through suction or the like by a suction mechanism provided in the liquid discharge apparatus. The present invention will be described in more detail with reference to the following exemplary embodiment.

Figure 9A:
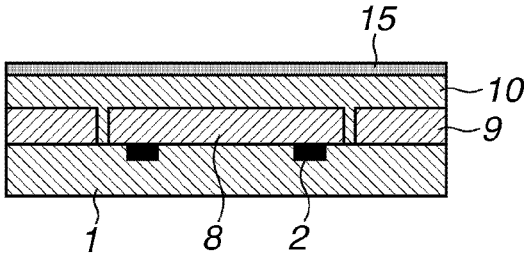
FIGS. 9A through 9F are schematic sectional views illustrating how each process is performed in a liquid discharge head manufacturing method according to the exemplary example of the present invention.

A third exemplary embodiment of the present invention will be described with reference to FIGS. 9A through 9F. FIGS. 9A through 9F are sectional views each showing the section in each process. The sections of FIGS. 9A through 9F are similar to those of FIGS. 2A through 2J. In the present exemplary embodiment, the processes up to the process illustrated in FIG. 2C are conducted in the same way as in the first exemplary embodiment. Next, the following is performed in the process for forming the member(B) 11. First, as illustrated in FIG. 9A, as in the case of FIG. 3A illustrating the second exemplary embodiment, there is provided on the upper surface of the second layer 10 a liquid-repellent material 15 for imparting repellency thereto. As in the second exemplary embodiment, a material is adopted, as the liquid-repellent material 15, to perform patterning on the liquid-repellent material 15 and the second layer 10 collectively by photolithography.

Figure 9B:
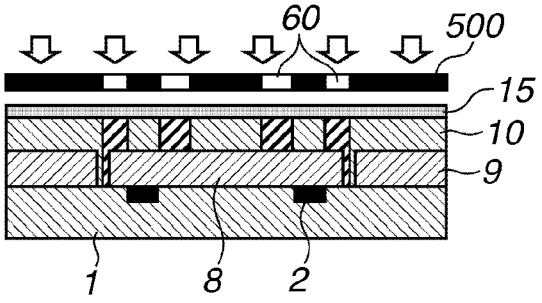

Next, as illustrated in FIG. 9B, the second layer 10 and the liquid-repellent material 15 are exposed to form the member (B) 11 via a mask 500. In this case, the exposure amount is E1, which satisfies the condition described below, and the configuration of the mask 500 has an opening pattern 60 adjusted to apply light solely to the portion to which repellency is to be imparted. Here, assuming that the optimum exposure amount providing sufficient liquid repellency and a satisfactory pattern configuration is E1 and that the minimum requisite exposure amount for effecting curing to the lowermost portions of the liquid-repellent material 15 and the second layer 10 is Eth, the following relationship holds true: Eth<E1; E1 may be set to 1.5 times Eth or more.

Figure 9C:
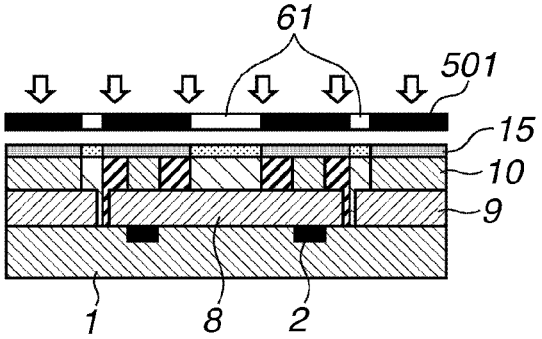

Next, as illustrated in FIG. 9C, the second layer 10 and the liquid-repellent material 15 are exposed via a mask 501. In this case, the exposure amount is E0, which satisfies the condition described below, and the configuration of the mask 501 has an opening pattern 61 adjusted to expose solely the portion where the second layer 10 and the third layer 12 are held in intimate contact with each other in FIG. 9E. Here, the exposure amount E0 is an irradiance amount which does not cause the liquid-repellent material 15 to exhibit repellency and which leads to insufficient curing of the portion where the liquid-repellent material 15 and the second layer 10 are stacked together. Thus, E0 is an exposure amount with which the following relationship holds true: E0<Eth; E0 may be set to be not less than ¼ but not more than ½ of Eth.

In this case, it is also possible to use a halftone mask for the opening of the mask 501. More specifically, by a halftone mask whose light transmittance is set to not less than ¼ but not more than ½, the actual light irradiance amount corresponds to E0 through exposure in the exposure amount E1. This also suggests that the processes of FIGS. 9B and 9C can be conducted in a collective process. By preparing a mask patterned with both the openings 60 of the mask 500 (light transmittance: 100%) and the openings 61 of the mask 501 (light transmittance: 25 to 50%), it is possible to collectively perform the exposure process.

Figure 9D:
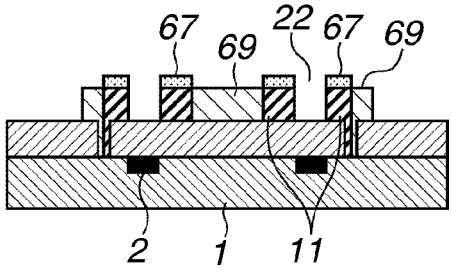
Figure 9E:
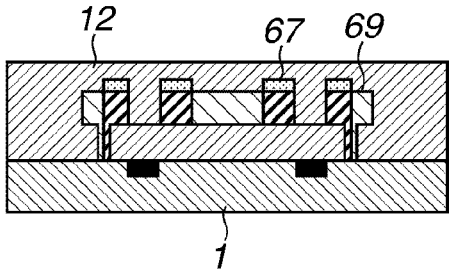

Next, development is performed after curing the portion that has been exposed, and the unexposed portions of the second layer 10 and of the liquid-repellent material 15 are removed. As illustrated in FIG. 9D, through the above processing, it is possible to provide, around the ports 22 constituting the discharge ports of the member (B) 11, liquid-repellent portions 67 to which repellency has been imparted. No liquid repellency is imparted to the portions, which is exposed with the amount of not more than Eth, corresponding to the openings 61; these portions constitute non-liquid-repellent portions 69. Next, after removing the material (A) 9, a third layer 12 is provided on the upper surface of the member (B) 11 as illustrated in FIG. 9E. In the liquid-repellent portions 67, it is possible that the third layer 12 is repelled, whereas, in the non-liquid-repellent portions 69 on the upper surface of the member (B) 11, the third layer 12 is held in intimate contact with the upper surface of the member (B) 11. Further, also the outer side surface of the member (B) 11, to which no repellency has been imparted, is held in intimate contact with the third layer 12. Further, as needed, it is possible to provide repellency with the liquid-repellent material 15 on the third layer 12 (not illustrated).

Figure 9F:
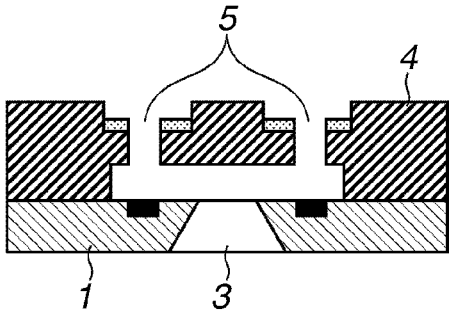

After this, as in the second exemplary embodiment, a necessary portion of the third layer 12 is cured to form the supply hole 3 in the substrate 1 and to form the flow path 6 by removing the pattern 8, thereby obtaining the liquid discharge head as illustrated in FIG. 9F.

Figure 10A:
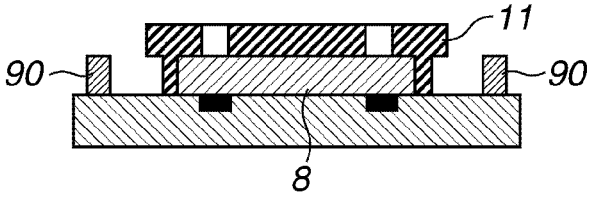
FIGS. 10A through 10E are schematic sectional views illustrating how each process is performed in a liquid discharge head manufacturing method according to the exemplary example of the present invention.
Figure 10B:
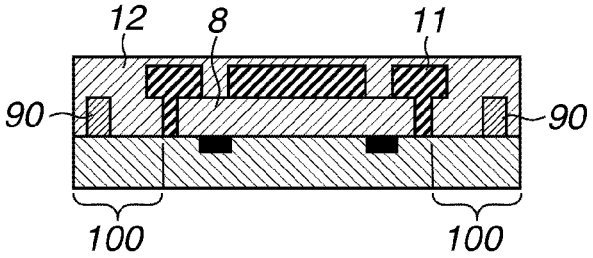
Figure 10C:
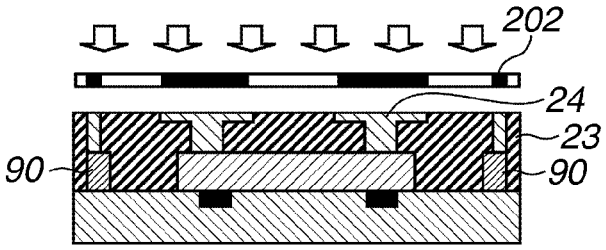

A fourth exemplary embodiment of the present invention will be described with reference to FIGS. 10A through 10E. In the present exemplary embodiment, the member (A) 9 is partially removed. FIGS. 10A through 10E are sectional views each illustrating the section in each process. The sections of FIGS. 10A through 10E are similar to those of FIGS. 2A through 2J. Next, as illustrated in FIG. 10A, in the process of removing the member (A) 9, the member (A) 9 is partially removed, whereby the portions of the member (A) 9 remaining on the substrate are obtained as a member (C) 90. In this exemplary embodiment, the portion of the member (A) 9 in contact with the member (B) 11 is removed. Next, as illustrated in FIG. 10B, the third layer 12 is provided on the member (C) 90. By preparing the member (C) 90, it becomes easier for the third layer 12 to get on the member (B) 11, which is effective in improving the strength at the end portion of the flow path wall member 12. Next, as illustrated in FIG. 10C, the portion of the third layer 12 on the member (C) 90 is shielded and the third layer 12 is exposed.

Figure 10D:
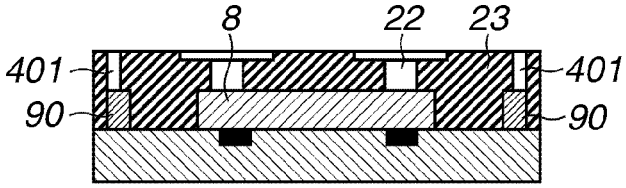
Figure 10E:
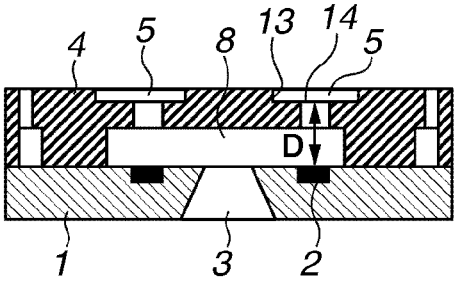

Next, as illustrated in FIG. 10D, along with the openings 22 constituting the discharge ports, openings 401 are formed to expose the member (C) 90. Next, as illustrated in FIG. 10E, the member (C) 90 is removed. As a result of the removal of the member (C) 90, a space is formed; it is possible to secure the requisite thickness of the flow path wall member to provide a certain distance from the side end of the member (B) 11 to the member (C) 90.

An exemplary example will be described with reference to FIG. 2. First, A substrate 1 (6-inch wafer) provided with a first layer 7 was prepared (FIG. 2A). The first layer 7 was formed by drying at 120 degrees Celsius after application through spin coating of ODUR-1010 (manufactured by TOKYO OHKA KOGYO CO., LTD), which is a positive type photosensitive resin. After the formation, the average value of the thickness of the first layer 7 was 7 micrometers, and the standard deviation (as measured at 350 positions in the 6-inch wafer) of the thickness of the first layer 7 within the substrate 1 (6-inch wafer) was not more than 0.1 micrometers.

Next, the first layer 7 was exposed using a mask, and the exposed portion was removed to thereby obtain a member (A) 9 and a pattern 8 (FIG. 2B). At this time, the length L of the gap 30 between the member (A) 9 and the pattern 8 was 30 micrometers.

Next, a composite containing the components as shown in Table 1 was applied to the member (A) 9 and the pattern 8 by spin coating, and a second layer 10 was formed by drying for three minutes at 90 degrees Celsius (FIG. 2C). The average value of the thickness of the second layer 10 was 5 micrometers, and the standard deviation of the thickness (as measured at 350 positions in the 6-inch wafer) was 0.2 micrometers.

TABLE 1

(Composite for Forming Second Layer 10)

| Composite | Parts by weight |
|---|---|
| EHPE-3150 (manufactured by DAICEL CHEMICAL INDUSTRIES, LTD.) | 100 parts |
| A-187 (manufactured by Nippon Unicar Company Limited) | 5 parts |
| Copper triflate | 0.5 parts |
| SP-170 (manufactured by ADEKA CORPORATION) | 0.5 parts |
| Methylisobutylketone | 100 parts |
| Xylene | 100 parts |

Next, the second layer 10 was exposed by mask aligner MPA-600 Super (product name) manufactured by Canon (FIG. 2D).

Next, post-bake and development were performed on the second layer 10 to form the member (B) 11 provided with holes 22 constituting the discharge ports (FIG. 2E). The exposure amount was 1 J/cm$^2$, and a mixture liquid of methylisobutylketone/xylene=⅔ was used as developer fluid, using xylene as the rinsing liquid for use after development. The diameter of the holes 22 was 12 micrometers.

Next, the member (A) 9 was exposed by mask aligner UX-3000SC (product name) manufactured by Ushio, Inc., deep-UV light (of a wavelength ranging from 220 nm to 400 nm) under a condition of 10 J/cm$^2$, and then the member (A) 9 was removed by dissolving it in methylisobutylketone (FIG. 2F). Next, the composite as shown in Table 1 was applied to the member (B) 11 to form the third layer 12 such that the thickness was 18 micrometers as measured from the surface of the substrate 1 to the upper surface of the portion of the third member 12 provided on the member(B) 11 (FIG. 2G).

Next, the third layer 12 was exposed (exposure amount=1 J/cm$^2$) by MPA-600 Super (product name; manufactured by Canon) (FIG. 2H), and post-bake, development, and rinsing were performed to integrate the exposed portion 23 of the third layer 12 with the member (B) 11 (FIG. 2I). As the developer fluid, a mixture liquid of methylisobutylketone/xylene=⅔ was used, and xylene was used as the rinsing liquid after development.

Using an aqueous solution at 80 degrees Celsius of tetramethyl ammonium hydroxide as the etching liquid, anisotropic etching was performed on the silicon substrate 1 to form the supply port 3. After this, the pattern 8 was dissolved in methyl lactate and was removed from the substrate 1 to form discharge ports 5 of a diameter of 12 micrometers (FIG. 2J).

In the substrate (6-inch wafer), the average value of the distance D was 12 micrometers, and the standard deviation of the distance D was 0.25 micrometers. The value of the distance D was obtained when 350 discharge ports were selected in the wafer evenly from the center of the wafer to the end portion and measurement were performed on each discharge port. Finally, the 6-inch wafer was cut by a dicing saw to obtain a single liquid discharge head.

Figure 6A:
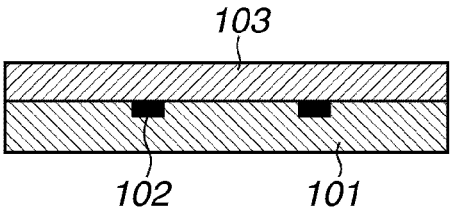
FIGS. 6A through 6F are schematic sectional views illustrating a liquid discharge head manufacturing method according to a comparative example.
Figure 6B:
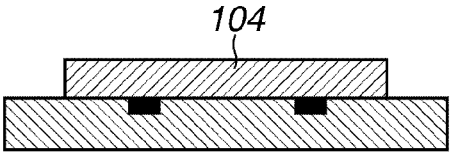

Referring to FIGS. 6A through 6F, a liquid discharge head producing method according to a comparative example will be described. Each of FIGS. 6A through 6F illustrates a surface of section in each of the processes of the liquid discharge head producing method of the comparative example. ODUR-1010 (product name; manufactured by TOKYO OHKA KOGYO CO., LTD was applied to a silicon substrate 101 (6-inch wafer) equipped with energy generation elements 102, and drying was effected thereon to form a positive type photosensitive resin layer 103 of a thickness of 7 micrometers on the substrate 101 (FIG. 6A). Next, exposure and development subsequent thereto were performed on the positive type photo sensitive resin layer 103 to form a flow path pattern 104 (FIG. 6B).

Figure 6C:
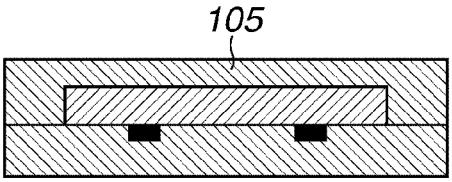
Figure 6D:
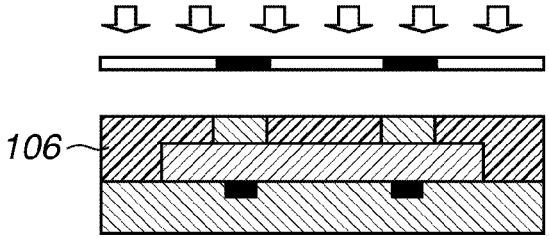
Figure 6E:
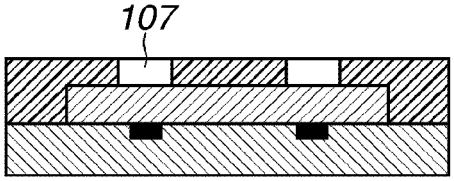
Figure 6F:
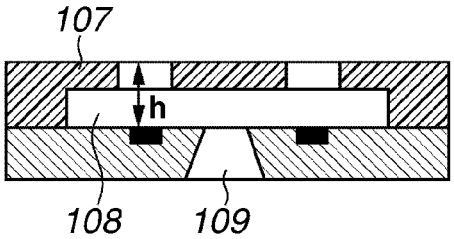

Next, the composite of Table 1 of exemplary Example was applied to the pattern 104 by spin coating, and was dried for three minutes at 90 degrees Celsius to form a coating layer 105. The coating layer 105 was formed, in which the thickness of the portion of the coating layer 105 provided on the upper surface of the pattern 104 was 7 micrometers (FIG. 6C). Next, the coating layer 105 was exposed using a mask and the exposed portion 106 was cured (FIG. 6D). Through development, the unexposed portion of the coating layer 105 was removed to form a member forming the flow path wall and discharge ports 107 of a diameter of 12 micrometers (FIG. 6E). Next, after forming a supply port 109 in the substrate 101, the pattern 104 was removed to form a flow path 108 (FIG. 6F).

Next, a 6-inch wafer was cut by a dicing saw to separate it into units of one liquid discharge head. In the obtained liquid discharge head, the average distance h from the energy generation surfaces of the energy generation elements 102 of the substrate 101 to the discharge ports 107 was 12 micrometers. On the other hand, the standard deviation of the distance h was 0.6 micrometers. The distance h is a value obtained through 350 discharge ports selected in the wafer evenly from the wafer center to the end portion, and by performing measurement on each discharge port.

It can be seen that there is a great difference between the standard deviation of the distance D of the liquid discharge head of exemplary Example and the standard deviation of the distance h of the liquid discharge head of Comparative Example. The standard deviation of the distance D was as small as 0.25 micrometers possibly owing to the fact that it was possible to obtain a member (B) 11 of a very small variation in thickness from the second layer 10 formed flat. This is because the member (B) 11 was formed from the second layer 10 in a state in which the second layer 10 was arranged on the pattern 8 and the member (A) 9 of high level of flatness.

On the other hand, one of the reasons that the standard deviation of the distance h was as large as 0.6 micrometers may be attributable to a difference in the height of the upper surface of the coating layer 105 between the portion of the coating layer 105 having the pattern 104 below and the portion having no pattern 104 below. Another reason may be that, in Comparative Example, no pattern 104 exists on the outer side of the pattern 104 further than the outermost peripheral portion of the 6-inch wafer, so that the height of the upper surface of the coating layer 105 in the outer peripheral portion of the wafer was formed relatively low as compared with the central portion.

Next, durability test was conducted on the liquid discharge heads of exemplary Example and Comparative Example. Each liquid discharge head was immersed in ink BCI-6C (pH: approximately 9) manufactured by Canon, and was left for 100 hours to stand at a temperature of 121 degrees Celsius and under a pressure of 2 atmospheres. After this, each liquid discharge head taken out of the ink was observed for the interface between the substrate 1 and the flow path wall member. In none of the liquid discharge heads of the exemplary example and comparative example, separation between the substrate 1 and the flow path wall member 4 or deformation was confirmed. It was confirmed that, in the liquid discharge heads of the example, the flow path wall member had a sufficient mechanical strength and bonding property with respect to the substrate.

Using the liquid discharge heads of exemplary Example and Comparative Example, test recording was performed. Recording was performed with respect to a plurality of liquid discharge heads obtained by cutting out the same 6-inch wafer. An ink liquid was used which consisted of pure-water/diethyleneglycol/isopropyl-alcohol/lithium-acetate/black-dye-food-black2=79.4/15/3/0.1/2.5, and recording was performed in a discharge volume Vd=1 pl and at a discharge frequency f=15 kHz.

Observation of the images obtained by the recording showed that in the case where recording was performed by the liquid discharge heads of exemplary Example, recording images of very high quality was obtained. Further, the images were of high quality for all of the plurality of liquid discharge heads obtained from the same 6-inch wafer. On the other hand, in the case where recording was performed by the liquid discharge head of the comparative example, unevenness was observed in the images as compared with the recording images obtained by the liquid discharge heads of the example. Further, the unevenness condition slightly differed between the recording images obtained by a plurality of liquid discharge heads produced out of the same 6-inch wafer. This may be possibly owing to the fact that the standard deviation of the above-described distance D is smaller than the standard deviation of the distance h. As a consequence, the variation in the volume of the ink discharged from the liquid discharge heads of the example is smaller than the variation in the volume of the ink discharge from the liquid discharge head of the comparative example.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2010-082799 filed Mar. 31, 2010 and No. 2010-265096 filed Nov. 29, 2010, which are hereby incorporated by reference herein in their entirety.

The invention claimed is:

1. A method of manufacturing a liquid discharge head having a flow path communicating with a discharge port for discharging liquid, comprising in the following order:

preparing a substrate with an evenly provided first layer;

forming, from the first layer, a pattern of the flow path for forming the flow path, and a first member provided outside the pattern via a gap;

providing a second layer to fill the gap and to cover the pattern and the first member;

forming, from the second layer, a second member for forming the discharge port above the pattern;

removing the first member and providing, at least on the substrate, a third layer to fill at least a part of an area where the first member is removed, and to contact with the second member; and removing the pattern to form the flow path.

2. The method according to claim 1, wherein the first member and the pattern are formed from the first layer by removing a part of the first layer.

3. The method according to claim 1, wherein, at the time of formation of the second member from the second layer, an opening constituting the discharge port is formed in the second member.

4. The method according to claim 3, wherein, prior to the forming of the third layer on the substrate, repellency is imparted to a portion around the opening of the second member.

5. The method according to claim 1, wherein, prior to the forming of the third layer on the substrate, a part of the surface of the second member on the side opposite to the substrate side is formed as a liquid-repellent portion, and wherein, when providing the third layer on the substrate, the portion of the surface of the second member that is not the liquid-repellent portion and the third layer are held in contact with each other.

6. The method according to claim 1, wherein the first member is formed to surround the pattern.

7. The method according to claim 1, wherein the size of the gap as measured in the direction along the surface of the substrate is 40 micrometers or less.

8. The method according to claim 1, wherein, at the time of the formation of the pattern and the first member from the first layer, the first layer is provided on a substrate provided with an adherence improving member corresponding to the configuration of the wall of the flow path, and wherein at least one of an upper surface side of the portion of the first layer corresponding to the pattern and the upper surface side of the portion of the first layer corresponding to the first member is partially removed such that the upper surface of the pattern and the upper surface of the first member are aligned with each other.

9. The method according to claim 8, wherein, at the time of the formation of the pattern and the first member from the first layer, the upper surface side portion of the adherence improving portion of the first layer is removed.

10. The method according to claim 1, wherein the first layer is formed of a positive type photosensitive resin, and wherein, at the time of the formation of the pattern and the first member from the first layer, exposure is effected on the first layer and the portion on which exposure has been effected is removed, whereby at least one of the upper surface side of the portion of the first layer corresponding to the pattern and the upper surface side of the portion of the first layer corresponding to the first member is partially removed, and the pattern and the first member are formed.

* * * * *